US009030099B2

(12) United States Patent
Checca et al.

(10) Patent No.: US 9,030,099 B2
(45) Date of Patent: May 12, 2015

(54) HIGH PRESSURE DISCHARGE LAMP WITH MULTIPLE ARC TUBES

(71) Applicants: Domenic Checca, Stoneham, MA (US); David Hrubowchak, Litchfield, NH (US)

(72) Inventors: Domenic Checca, Stoneham, MA (US); David Hrubowchak, Litchfield, NH (US)

(73) Assignee: OSRAM SYLVANIA Inc., Danvers, MA (US)

( * ) Notice: Subject to any disclaimer, the term of this patent is extended or adjusted under 35 U.S.C. 154(b) by 75 days.

(21) Appl. No.: 13/890,375

(22) Filed: May 9, 2013

(65) Prior Publication Data

US 2014/0333192 A1 Nov. 13, 2014

(51) Int. Cl.

| | |
|---|---|
| ***H01J 61/10*** | (2006.01) |
| ***H01J 61/34*** | (2006.01) |
| ***H01J 17/16*** | (2012.01) |
| ***H01J 61/54*** | (2006.01) |
| ***H01J 61/92*** | (2006.01) |
| ***H01J 9/24*** | (2006.01) |

(52) U.S. Cl.
CPC ..... *H01J 61/545* (2013.01); *H01J 61/92* (2013.01); *H01J 9/247* (2013.01)

(58) Field of Classification Search
CPC ..... H01J 61/547; H01J 61/545; H01J 61/30; H01J 61/36; H01J 61/86; H01J 9/247
USPC ..... 313/594, 607, 3, 25
See application file for complete search history.

(56) References Cited

U.S. PATENT DOCUMENTS

| | | | | |
|---|---|---|---|---|
| 4,788,475 | A * | 11/1988 | Jacobs | 315/183 |
| 5,276,385 | A * | 1/1994 | Itoh et al. | 315/73 |
| 6,111,359 | A * | 8/2000 | Work et al. | 315/56 |
| 6,538,377 | B1 * | 3/2003 | Scott et al. | 313/567 |
| 6,661,171 | B2 * | 12/2003 | Hecker | 313/594 |
| 8,063,564 | B2 * | 11/2011 | Kostrun et al. | 313/594 |

* cited by examiner

*Primary Examiner* — Sikha Roy
(74) *Attorney, Agent, or Firm* — Andrew Martin

(57) ABSTRACT

A long life high pressure arc discharge lamp configuration is disclosed. In some embodiments, the lamp includes a first non-cycling high pressure arc tube having a first ignition aid and a second arc tube electrically connected in parallel to the first arc tube. A lamp envelope is provided about the first and second arc tubes. In some cases, each of the first and second arc tubes is a non-cycling high pressure sodium arc tube, and each is configured with an ignition aid strip running lengthwise down the corresponding arc tube. In some cases, the first and second arc tubes are oriented such that their respective ignition aid strips are effectively 180 degrees+/−90 degrees away from each other, or so that their respective ignition aid strips are effectively 180 degrees+/−5 degrees away from each other. In some such, the second arc tube is a low-pressure arc tube.

15 Claims, 6 Drawing Sheets

| 150 Watt Breakdown and Starting Voltages | | | 100 Watt Breakdown and Starting Voltages | |
|---|---|---|---|---|
| 2,440 Hours Aged | | | 8,000 Hours Aged | |
| Strips facing in (KV/1000) | | | Strips facing in (KV/1000) | |
| | Breakdown Voltage | First Start | Breakdown Voltage | First Start |
| 1 | 1.898 | 1.869 | 1.840 | 2.500 |
| 2 | 1.698 | 1.811 | 1.898 | 2.500 |
| 3 | 1.783 | 1.984 | 1.783 | 1.841 |
| 4 | 1.811 | 1.696 | 1.869 | 1.985 |
| 5 | 1.840 | 2.013 | 1.840 | 2.156 |
| 6 | 1.840 | 1.840 | 1.869 | 2.099 |
| 7 | 1.811 | 1.811 | 1.898 | 3.048 |
| 8 | 1.754 | 1.754 | | |
| 9 | 1.811 | 2.041 | | |
| **Average** | **1.805** | **1.869** | **1.857** | **2.304** |
| **Standard Deviation** | **0.057** | **0.120** | **0.040** | **0.410** |
| Strips facing out (KV/1000) | | | Strips facing out (KV/1000) | |
| 10 | 1.754 | 1.725 | 1.898 | 1.869 |
| 11 | 1.811 | 1.869 | 1.811 | 1.840 |
| 12 | 1.811 | 1.725 | 1.840 | 2.120 |
| 13 | 1.869 | 1.696 | 1.811 | 1.926 |
| 14 | 1.783 | 1.600 | 1.840 | 2.156 |
| 15 | 1.783 | 1.696 | 1.840 | 2.386 |
| 16 | 1.783 | 1.869 | 1.869 | 2.099 |
| 17 | 1.754 | 1.696 | | |
| 18 | 1.840 | 1.811 | | |
| 19 | 1.698 | 1.754 | | |
| **Average** | **1.789** | **1.744** | **1.844** | **2.057** |
| **Standard Deviation** | **0.048** | **0.084** | **0.031** | **0.193** |

Breakdown and Starting Voltages with Cermet Strips

Figure 5

HIGH PRESSURE DISCHARGE LAMP WITH MULTIPLE ARC TUBES

FIELD OF THE DISCLOSURE

The present application relates to lighting technology, and more particularly to non-cycling high pressure arc discharge lamps.

BACKGROUND

High pressure arc discharge lamps are useful in many applications, such as industrial installations, streets, tunnels, underpasses, car parks, courtyards, parks and gardens, buildings, monuments, and bridges, to name a few. Some particularly useful applications for high pressure arc discharge lamps are in areas where it is difficult to replace lamps, due to limited accessibility, such as streets and tunnels. High pressure arc discharge lamps can have a longer life than standard lamps and greater reliability than standard lamps making them the preferred lamp in many such applications.

BRIEF DESCRIPTION OF THE DRAWINGS

FIG. 5 illustrates comparative study data with breakdown and starting voltages of a high pressure arc discharge lamp configured with dual arc tubes having ignition aids of cermet strips arranged in different orientations to show benefits of a configuration having opposite-facing ignition aids in accordance with an embodiment of the present invention.

DETAILED DESCRIPTION

Figure 1A:
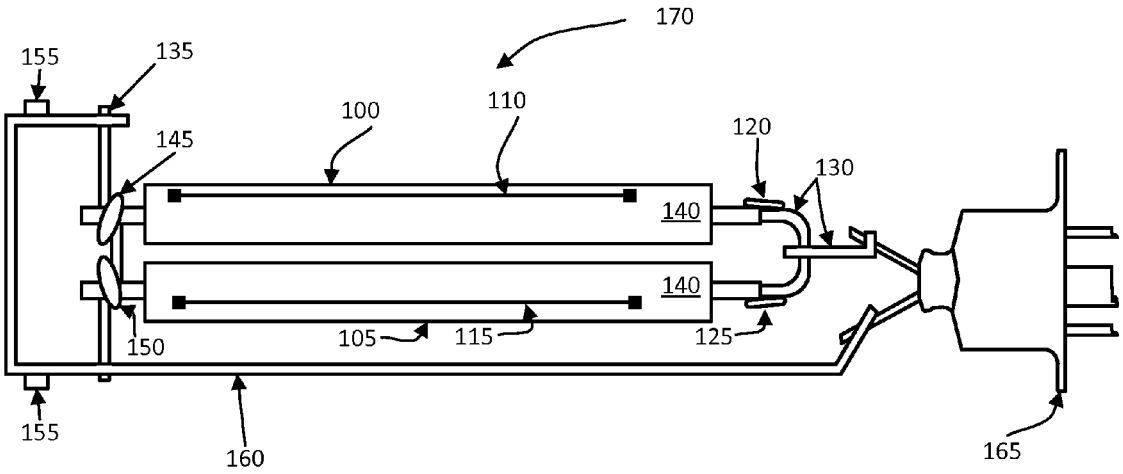
FIGS. 1A-B illustrate an arc tube assembly having two arc tubes configured in accordance with an embodiment of the present invention.

A long life non-cycling high pressure arc discharge lamp configuration is disclosed. In some example embodiments, a high pressure arc discharge lamp is provided that electrically combines in parallel, two non-cycling high pressure sodium discharge arc tubes within one lamp envelope, with the arc tubes having elongated cylindrical shapes and being arranged lengthwise alongside each other in a parallel fashion such that the arc tubes at least partially or completely overlap with one another. A small space is provided between the arc tubes (e.g., uniform 1-50 mm space, for instance), such that they are close but don't physically touch one another. At least one of the arc tubes is configured with an ignition aid strip, such as cermet strip, located substantially lengthwise on the exterior surface of one or both arc tubes. In one particular embodiment, both arc tubes are configured with such an ignition aid strip, and the tubes are oriented such that their respective ignition aid strips are both facing outward with respect to one another. This has the effect of reducing the thermal load that the ignition aid of the non-operating arc tube is subjected during operation, which leads to sustained ignition performance. In another embodiment, one arc tube is a non-cycling high pressure sodium discharge arc tube having an ignition strip and a second arc tube is a low-pressure arc tube with no ignition strip. Numerous other lamp configurations will be apparent in light of this disclosure.

General Overview

As previously noted, high pressure arc discharge lamps can have a longer life than standard lamps and are useful in numerous applications. By extending re-lamp schedules, a number of benefits can be realized, including lower environmental impact, reduced maintenance costs, and increased safety (reducing re-lamp events reduces the opportunity for injury during re-lamp process). Typical high pressure arc tube lamp assemblies have life cycles of approximately forty-thousand hours and employ amalgam metallic sodium and mercury doses to prevent lamp cycling behavior. An even longer life lamp would be desirable, and particularly a lamp that provides fast start-up times for initial power applications and fast start-up times after a power interruption.

Thus, and in accordance with an embodiment of the present invention, a long life non-cycling high pressure arc tube lamp is disclosed. The lamp may be configured with, for example, dual high pressure sodium arc tubes having elongated cylindrical shapes electrically connected and physically arranged in parallel with a small gap therebetween. Each elongated cylindrical arc tube has an inward facing semicylinder portion and an outward facing semicylinder portion, wherein the inward facing semicylinder portions of the arc tubes face each other and the respective outward facing semicylinder portions are opposite-facing. In one particular such example embodiment, each of the arc tubes is configured with an ignition aid strip running lengthwise on the arc tube and disposed somewhere on the outward facing semicylinder portion of the respective arc tube. In this sense, the arc tubes are oriented such that their respective ignition aid strips are effectively 180 degrees+/−90 degrees away from each other.

By combining two or more arc tubes in one lamp envelope, the lamp will effectively have double the life expectancy or more, depending on the arc tube configuration, as compared to a single arc tube construction. When one arc tube fails, any of the remaining arc tubes within the lamp envelope can then become the operative arc tube, given the nature of the electrically parallel configuration and arc tube turn-on characteristics (ignition performance), thereby extending the life of that particular lamp. In addition, having opposite-facing ignition strips as described herein can be used to further extend the life of the lamp by minimizing the thermal load during operation which leads to sustained ignition performance of any arc tube within that lamp envelope.

In alternative arrangements, the respective ignition aid strips need not be 180 degrees +/−90 degrees away from each other. However, in such configurations, the life of the lamp may generally be shorter than a configuration where the respective ignition aid strips are 180 degrees +/−90 degrees away from each other. It is believed that the thermal load management is improved in such a configuration, thereby allowing for longer lamp life. In more detail, during initial power up of a multiple arc tube lamp configuration as described herein, the arc tube with the lowest breakdown voltage lights first. A number of variables affect the breakdown voltage, such as contamination during arc tube assembly, resulting in higher breakdown voltages (such contamination being generally acceptable). Arc tubes having an ignition aid generally have lower breakdown voltages than arc tubes without. Cycled thermal exposure of the ignition aid, such as a cermet strip, on a non-operating arc tube, located with the non-operating arc tube cermet strip facing toward the operating arc tube, leads to conductivity changes in the ignition aid strip of the non-operating arc tube which leads to higher breakdown voltages for that arc tube. Thus, if the ignition aid strips face each other, breakdown voltages become higher over time. This thermal exposure can be minimized or otherwise reduced by locating the ignition aid such that it is facing away from the operating arc tube, as variously discussed herein, so as to achieve sustained lower breakdown voltages. In still other example embodiments, only one of the arc tubes within the lamp envelope is configured with an ignition aid strip. In one such specific example embodiment, the arc tube configured with the ignition aid strip is a non-cycling high pressure sodium discharge arc tube and the other arc tube can be, for example, a low-pressure arc tube.

The ignition aid strip can be implemented as typically done or using any suitable custom or proprietary process and materials. For instance, in some cases the ignition strip can be applied as a tungsten-containing paste (e.g., pure tungsten or a tungsten/alumina cermet) to the outside of the arc tube prior to sintering the arc tube to translucency. The arc tube can be any number of suitable materials such as polycrystalline alumina (PCA) or other suitable ceramic material. In some cases, the thermal expansion coefficient of the ignition aid material is closely matched to that of the arc tube so as to inhibit cracking of the strip (e.g., so that thermal expansion coefficients are within 10% of each other) For example, in one specific such example case, the ignition aids can be implemented with a conductive refractory metal nitride strip (e.g., titanium nitride or zirconium nitride) applied directly to the surface of a PCA arc tube. The metal nitride strip may be applied by any suitable means (e.g., aerosol spraying, ink pen, inkjet, or vapor deposition), and can then be sintered with the ceramic arc tube to bond it to the arc tube surface. In some cases, the metal nitride ignition aid material can be mixed with a ceramic material (e.g., aluminum oxide or aluminum oxynitride).

As will be further appreciated in light of this disclosure, the techniques are particularly useful for non-cycling high pressure sodium lamp configurations. In one specific example non-cycling arc tube configuration, for instance, the arc tubes are filled with an amalgam of mercury and sodium at a suitable ratio along with xenon gas. In addition, a dual arc tube configuration can be used to perform fast re-strike during power interruption. For instance, in operation, only one arc tube is operating at a time. The second non-operating arc tube remains at a lower pressure allowing it to strike and warm-up quickly should a power interruption occur. After a power interruption event, the previously operating arc tube must cool down before starting again, but the second previously non-operating arc tube strikes and warms up almost immediately. Additionally, a lamp constructed with non-cycling arc tubes generally has a very low total mercury content making it TCLP-compliant (Toxicity Characteristics Leaching Procedure) and environmentally friendly. Numerous variations and configurations will be apparent in light of this disclosure.

In accordance with another example embodiment, multiple arc tube pairs are arranged within a given lamp envelope, wherein the pairs can be arranged in a collinear fashion. In such an embodiment, shadowing effects may be reduced by the collinear arrangement and the product life can be even further extended by having multiple arc tube pairs. In still another embodiment, alternative ignition aids can be used such as helical wires, non-linear capacitors, UV globottles, and other non-cermet based methods can be employed to minimize the thermal effects of a multiple arc tube assembly.

Lamp Architecture

Figure 1B:
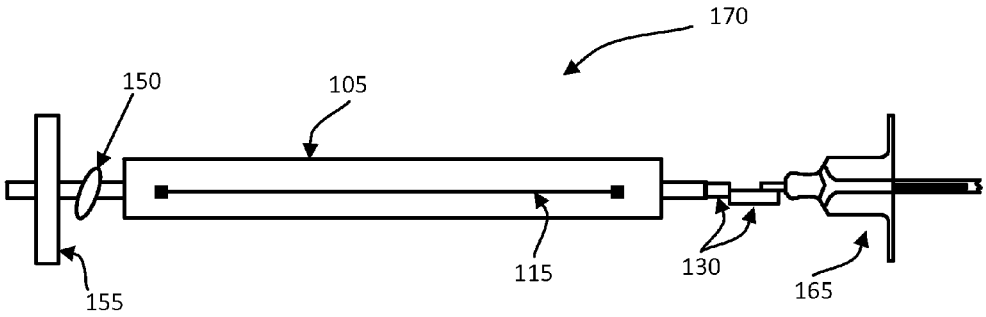

FIG. 1A illustrates an arc tube assembly 170 configured in accordance with an embodiment of the present invention. FIG. 1B shows another view of assembly 170. As can be seen, this example assembly includes two arc tubes 100 and 105 physically arranged in parallel, and electrically connected in parallel by a conductive wire 135 at one end and a conductive u-shaped portion of support bracket assembly 130 at the other end of the arc tubes. The electrodes at one end of the arc tubes 100 and 105 are received into loops 145 and 150 of wire 135, which may assist in the assembly process. In one example case, welds at locations 120 and 125, as well as at loops 145 and 150 can be used to secure the assembly. Note in one such embodiment that the welds can be placed in substantially the same plane for automation of assembly, or to otherwise facilitate manufacturing.

In addition, this example embodiment includes an amalgam of metallic sodium and mercury 140 inside both arc tubes 100 and 105, so as to provide non-cycling high pressure sodium lamp. Each arc tube 100 and 105 of this example configuration includes an ignition aid strip 110 and 115, respectively, wherein each strip 110 and 115 runs lengthwise down its corresponding arc tube. In the embodiment shown, the arc tubes 100 and 105 are oriented so that ignition aid strips 110 and 115 face away from each other. Example orientations of the ignition strips will be discussed with further reference to FIGS. 3A-C. As will be appreciated in light of this disclosure, the assembly may include additional, fewer, and/or different elements or components from those illustrated.

As can be further seen with respect to FIGS. 1A-B, a conductive frame 160 electrically connects one end of the arc tube electrodes to one of the electrodes of stem 165. The other electrode of the stem 165 is connected to the other end of the arc tube electrodes via an L-shaped portion of the support bracket 130. A spacer 155 is attached to the frame 160 to prevent the assembly from directly contacting the lamp envelope (not shown) and to provide structural support. The frame 160 is removed in the view of FIG. 1B to allow for depiction of other features components. The ignition aid strips 110 and 115 can be implemented, for example, with cermet strips that have been applied to the corresponding arc tubes 100 and 105, although any suitable ignition aid strip technology can be used, including any of those mentioned herein. As can further be seen in the example embodiment of FIGS. 1A-B, the arc tube 100 of this example configuration is oriented such that its ignition aid strip 115 faces away from the ignition aid strip 110 of the adjacent arc tube 100.

Figure 2:
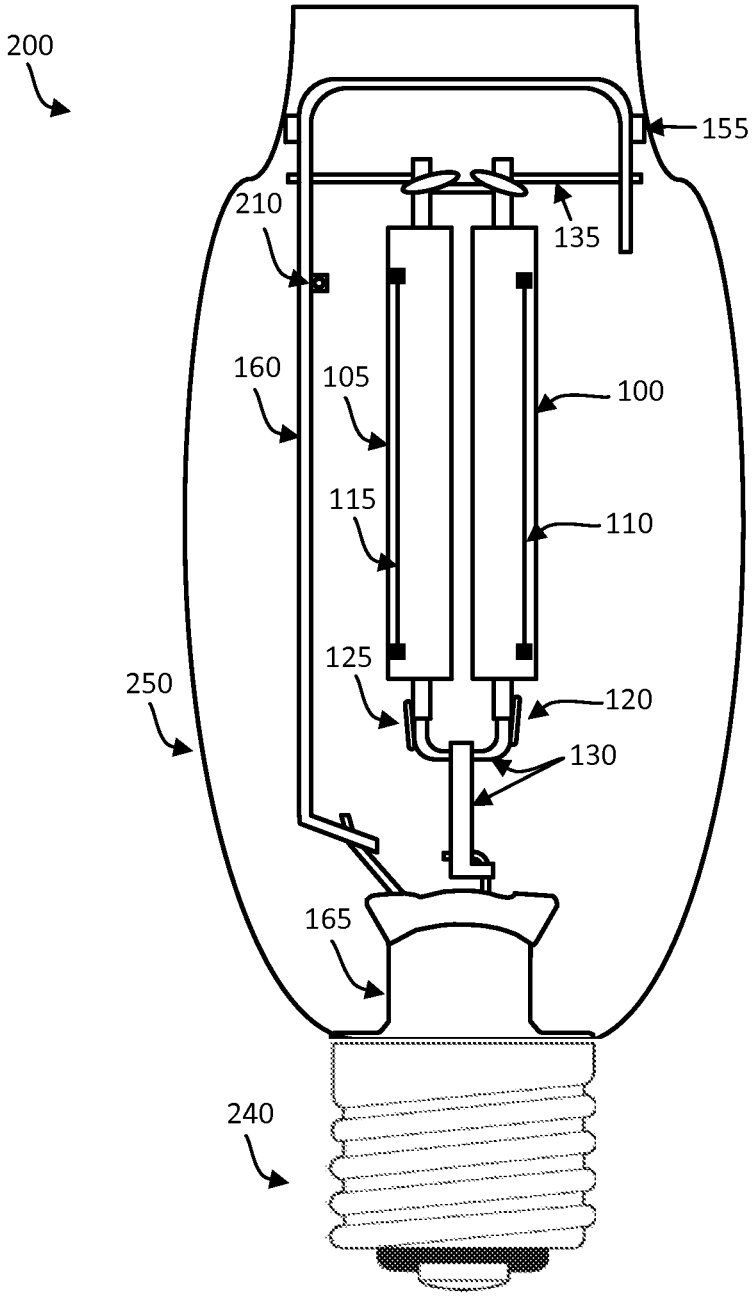
FIG. 2 illustrates a high pressure arc discharge lamp assembly configured in accordance with an embodiment of the present invention.

FIG. 2 illustrates a high pressure arc discharge lamp assembly 200 configured in accordance with an embodiment of the present invention. As can be seen, an arc tube assembly similar to the one shown in FIGS. 1A-B is included within a lamp envelope 250. A getter 210 is mounted to the frame 160 to absorb material that is outgassed by the arc tubes 100 and 105 and other lamp components. The arc tube assembly 170 is inserted into a lamp envelope 250 and a base 240 is connected. The arc tube assembly is configured with the respective ignition aid strips 110 and 115 facing away from each other, effectively in the range of 180 degrees+/−90 degrees away from each other.

Figure 3A:
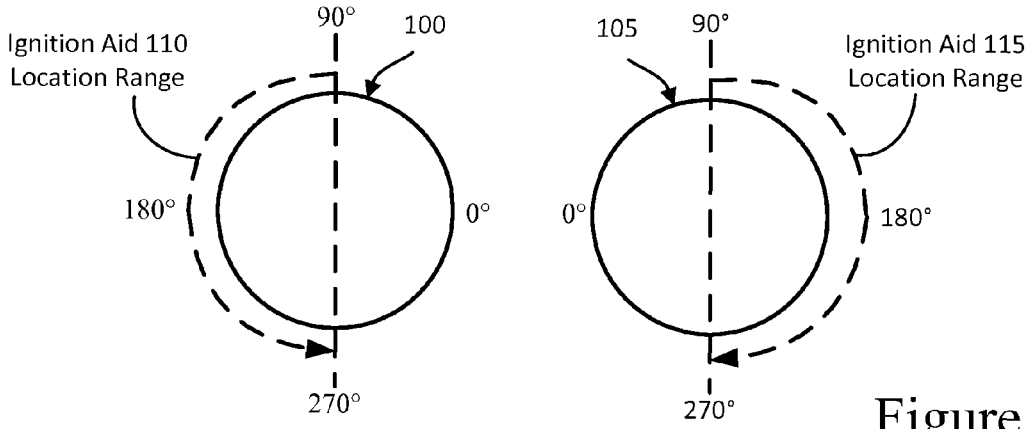
FIG. 3A illustrates a partial cross-sectional view of an arc tube assembly having two arc tubes configured with opposite-facing ignition aids in accordance with an embodiment of the present invention.
Figure 3B:
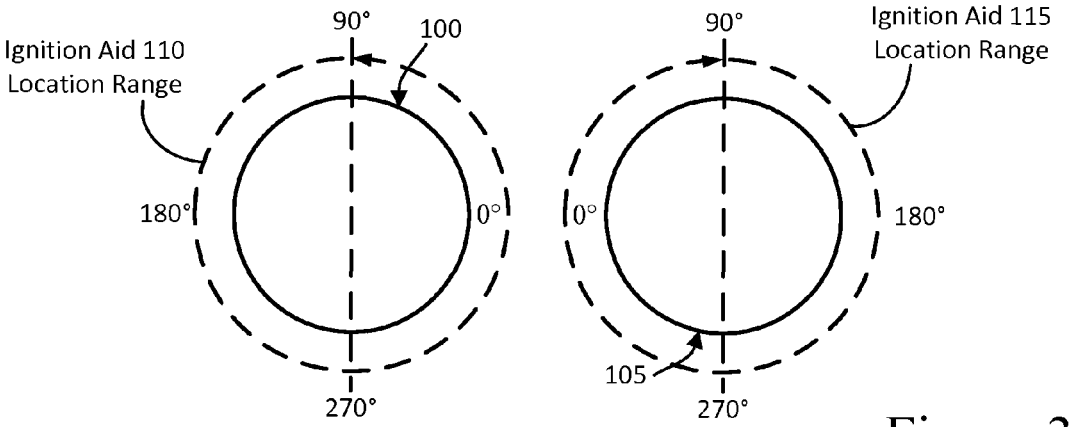
FIG. 3B illustrates a partial cross-sectional view of an arc tube assembly having two arc tubes configured with arbitrarily positioned ignition aids in accordance with an embodiment of the present invention.
Figure 3C:
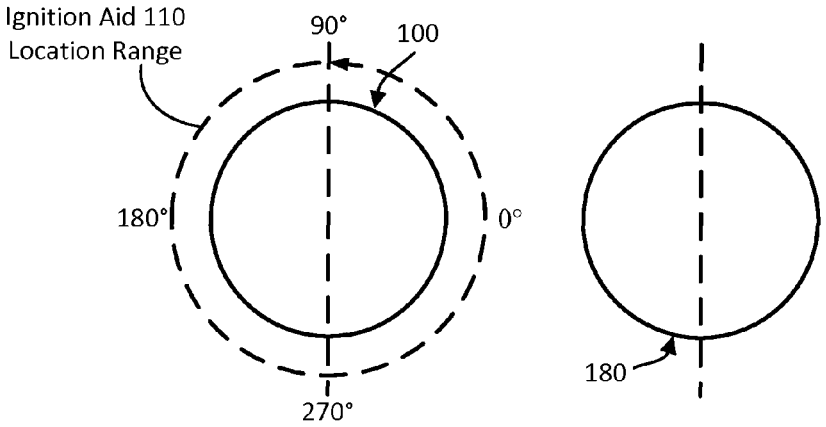
FIG. 3C illustrates a partial cross-sectional view of an arc tube assembly having two arc tubes configured with an ignition aid in accordance with an embodiment of the present invention.

FIGS. 3A-C each illustrates a partial cross-sectional view of a dual arc tube assembly configured in accordance with an embodiment of the present invention. As can be seen, the cross-section is taken perpendicularly to an axis that runs longitudinally and lengthwise through the arc tube, so that the ignition aid location range can be shown. Numerous variations will be apparent in light of this disclosure.

As can be seen with respect to the example embodiment of FIG. 3A, the ignition aid strips 110 and 115 on each arc tube 100 and 105 can be located anywhere within a corresponding ignition aid location range. In more detail, each elongated cylindrical arc tube has an inward facing semicylinder portion and an outward facing semicylinder portion. The inward facing semicylinder portions of the arc tubes face each other and fall within the range designated as 0 degrees+/−90 degrees on each arc tube 100 and 105, and the outward facing semicylinder portions are opposite-facing and fall within the range designated as 180 degrees+/−90 degrees on each arc tube 100 and 105 (also labeled ignition aid 110 location range and ignition aid 115 location range, respectively). In one particular such example embodiment, each of the ignition aid strips 110 and 115 runs in a relatively straight line lengthwise on the corresponding arc tubes 100 and 105, respectively, and each arc tube 100 and 105 is oriented such that its corresponding ignition aid strip 110/115 is on the outward facing semicylinder portion of that arc tube at 180 degrees (+/−10 degrees). In another embodiment, arc tube 100 is oriented so that ignition aid strip 110 is on the outward facing semicylinder portion of arc tube 100 at 105 degrees (+/−15 degrees), and arc tube 105 is oriented so that ignition aid strip 115 is on the outward facing semicylinder portion of arc tube 105 at 100 degrees (+/−10 degrees). In another embodiment, arc tube 100 is oriented so that ignition aid strip 110 is on the outward facing semicylinder portion of arc tube 100 at 115 degrees (+/−15 degrees), and arc tube 105 is oriented so that ignition aid strip 115 is on the outward facing semicylinder portion of arc tube 105 at 255 degrees (+/−15 degrees).

Note that the ignition aid strips 110 and 115 need not be located such that they are opposite-facing in a perfectly symmetrical fashion (e.g., such as the case where both strips are located at 180 degrees, or the case where one strip is located at 90 degrees and the other strip is located at 270 degrees). In a more general sense, the ignition aid strips can be located anywhere within the ignition aid location range, which happens to correspond to the outward facing semicylinder portion of each arc tube in this example case. Maximizing the distance of a given strip from the opposing arc tube can be beneficial, as will be appreciated in light of this disclosure. Further note that while straight ignition aid strips are shown, they may also be implemented in other shapes such as a sine wave shape, triangle wave shape, square wave shape, irregular line shape, or any other desired shape. The thickness of the ignition aid strip 110 and 115 may be uniform, but need not be, and may include any number of thickness variations and patterns along the length of the strip. Note in such alternative strip configurations, the strip may meander anywhere within the given ignition aid location range, such as from 180 degrees+/−90 degrees in a linear or non-linear fashion.

As can be seen with respect to the example embodiment of FIG. 3B, the ignition aid location range need not be limited to the range of 180 degrees+/−90 degrees, as shown in FIG. 3A. As previously explained, the life of the high pressure discharge lamp can still be extended by virtue of having multiple arc tubes configured and arranged to effectively provide a failover when one of the arc tube fails or otherwise fails to meet ignition criteria. If the ignition aid strips are both disposed within the 0 degrees+/−90 degrees, then the benefits described herein with respect to opposite-facing ignition aid strips will be lacking or otherwise diminished, depending on the particular positioning provided. In one particular example embodiment, each of the ignition aid strips 110 and 115 runs in a relatively straight line lengthwise on the corresponding arc tubes 100 and 105, respectively, and arc tube 100 is oriented so that ignition aid strip 110 is on the inward facing semicylinder portion of arc tube 100 at 75 degrees (+/−15 degrees), and arc tube 105 is oriented so that ignition aid strip 115 is on the inward facing semicylinder portion of arc tube 105 at 300 degrees (+/−15 degrees). In another such cases, arc tube 100 is oriented so that ignition aid strip 110 is on the outward facing semicylinder portion of arc tube 100 at 180 degrees (+/−15 degrees), and arc tube 105 is oriented so that ignition aid strip 115 is on the inward facing semicylinder portion of arc tube 105 at 300 degrees (+/−15 degrees). As will be appreciated in light of this disclosure, the further an ignition aid strip is positioned from the opposing arc tube, the lower the thermal impact on that ignition aid, thereby providing a longer life to the lamp. Thus, a configuration where arc tube 100 is oriented so that ignition aid strip 110 is on the inward facing semicylinder portion of arc tube 100 at 0 degrees (+/−1 degree), and arc tube 105 is oriented so that ignition aid strip 115 is on the inward facing semicylinder portion of arc tube 105 at 0 degrees (+/−1 degree) will likely provide the least amount of benefit with respect to managing thermal impact on the ignition aid strips 110 and 115. Note that the orientation where each strip is located at 180 degrees (+/−1 degree) is not necessarily the best orientation with respect to thermal management, depending on the lamp envelope configuration. For instance, in some cases, one strip is located at 112.5 degrees (+/−5 degrees) and the other strip is located at 202.5 degrees (+/−5 degrees).

FIG. 3C illustrates a high pressure arc tube 100 that is paired with a low-pressure arc tube 180. In such cases, the ignition aid strip 110 can be deployed anywhere on arc tube 100. In one specific example case, the arc tube 100 is oriented such that the ignition aid strip 110 is located at 180 degrees+/−90 degrees. The low-pressure arc tube 180 need not be configured with an ignition aid.

Multiple Arc Tube Pairs

Figure 4:
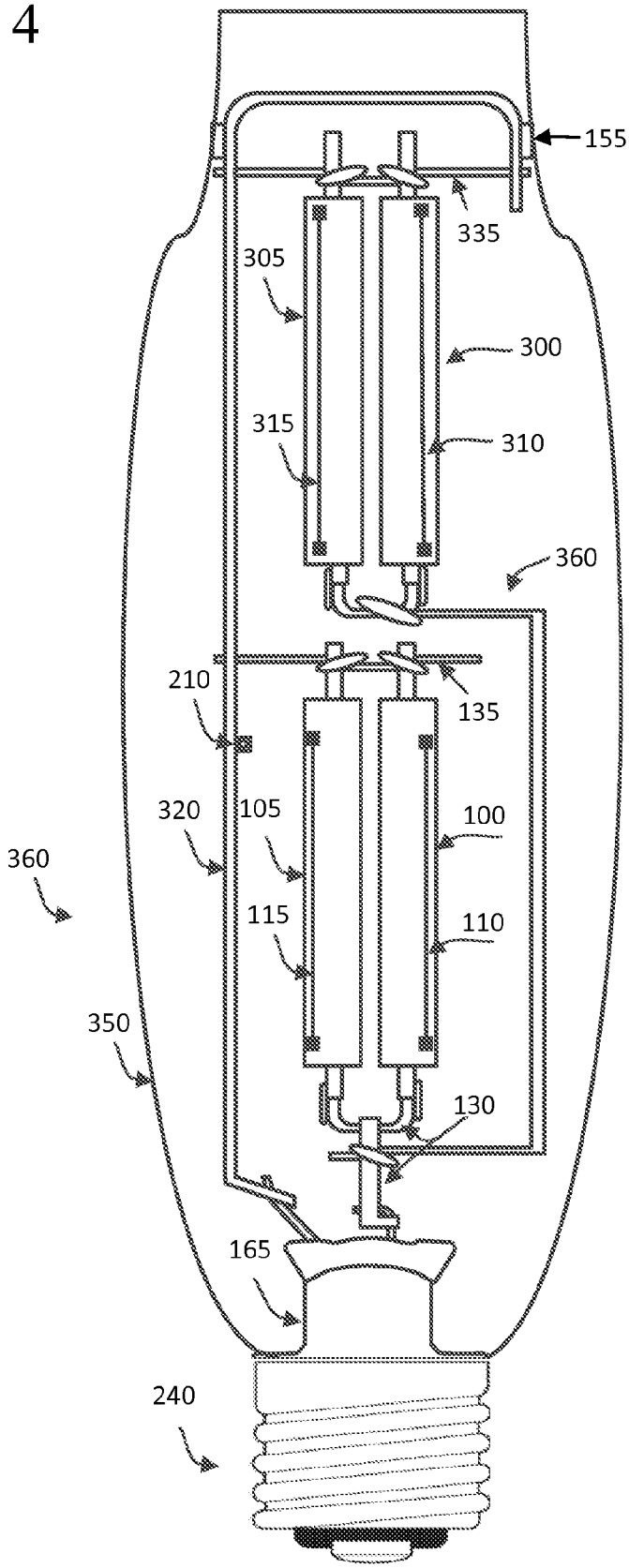
FIG. 4 illustrates a high pressure arc discharge lamp configured in accordance with another embodiment of the present invention.

FIG. 4 illustrates a non-cycling high pressure arc discharge lamp 360 configured in accordance with another embodiment of the present invention. As can be seen, this example configuration effectively includes two arc tube pair assemblies similar to the one shown in FIGS. 1A-B. In this example embodiment, one arc tube assembly (including arc tubes 100 and 105 electrically connected in parallel) is electrically connected in parallel with the other arc tube assembly (including arc tubes 300 and 305 also electrically connected in parallel). The arc tube pairs are oriented in substantially collinear fashion. An additional conductive wire 335 is welded to the arc tubes 300 and 305 and the extended frame 320. A single getter 210 is shown mounted to the extended frame 320, however, additional getters may be used. For example, a second getter may be located on the extended frame 320 adjacent to the arc tubes 300 and 305. The arc tubes 300 and 305 are also electrically connected to a second frame 360, which is electrically connected to the L-shape portion of the connector assembly 130. As can be further seen, one end of arc tubes 100 and 105 is electrically connected to the frame 320 via wire 135. The frames 320 and 360 are electrically connected to electrodes of the stem 165. The entire arc tube assembly is inserted within a lamp envelope 350 and a base 240 is connected, forming the overall lamp assembly 360. In the embodiment shown, all the arc tubes have ignition aid strips (110, 115, 310, and 315). The ignition aid strip pairs (310/315 and 110/115) can be oriented as discussed with reference to FIG. 3A or 3B, and that previous disclosure is equally applicable here, as is other relevant previous disclosure with respect to configurations including a combination of low-pressure and high pressure arc tubes.

Comparative Data

FIG. 5 illustrates comparative study data with breakdown and starting voltages of a high pressure arc discharge lamp configured with dual arc tubes having ignition aids of cermet strips arranged in different orientations to show benefits of a configuration having opposite-facing ignition aids in accordance with an embodiment of the present invention. The test results for one-hundred-fifty (150) watt and one-hundred (100) watt lamps configured in accordance with embodiments of the present invention are shown. As can be further seen, the upper portion of the comparative study shows test results for the 150 watt and 100 watt lamps configured with inward-facing ignition strips located at about 0°+/−5° ("Strip In") and the lower portion of the comparative study shows test results for the 150 watt and 100 watt lamps configured with outward-facing ignition strips located at about 180°+/−5° ("Strip Out"). Other than the ignition strip orientation, the lamps are configured the same and each include dual non-cycling high pressure sodium arc tubes generally arranged as shown in FIG. 2, each arc tube having a cermet ignition aid strip. Breakdown and starting voltages are indicators of the ease of starting the arc tube lamp. As can be seen from the test results, when the ignition aid is placed in close proximity to the operating arc tube (Strip In), the ignition aid strip suffers from conductivity changes, such as increased resistivity, which manifests as slightly higher breakdown voltage and starting voltage, and progressively worsening over time as the lamp ages. By orienting the arc tubes so that the ignition aid strips are facing away from the opposing arc tube as variously described herein, the cycled thermal exposure of the ignition aid strip is reduced. As a result, lower breakdown and starting voltages are required to start the arc tube, which tends to increase the overall life of the lamp.

As can be seen from FIG. 5, the mean breakdown and starting voltages are lower when configured with ignition aid strips facing-out, and are higher when configured with ignition aid strips facing-in. In each case, when the cermet strips are facing-out, the mean starting and breakdown voltages are lower than when the cermet strips are facing-in. As a result, a lamp having ignition aid strips facing out will generally tend to have a longer life than if the strips were facing-in.

Figure 6:
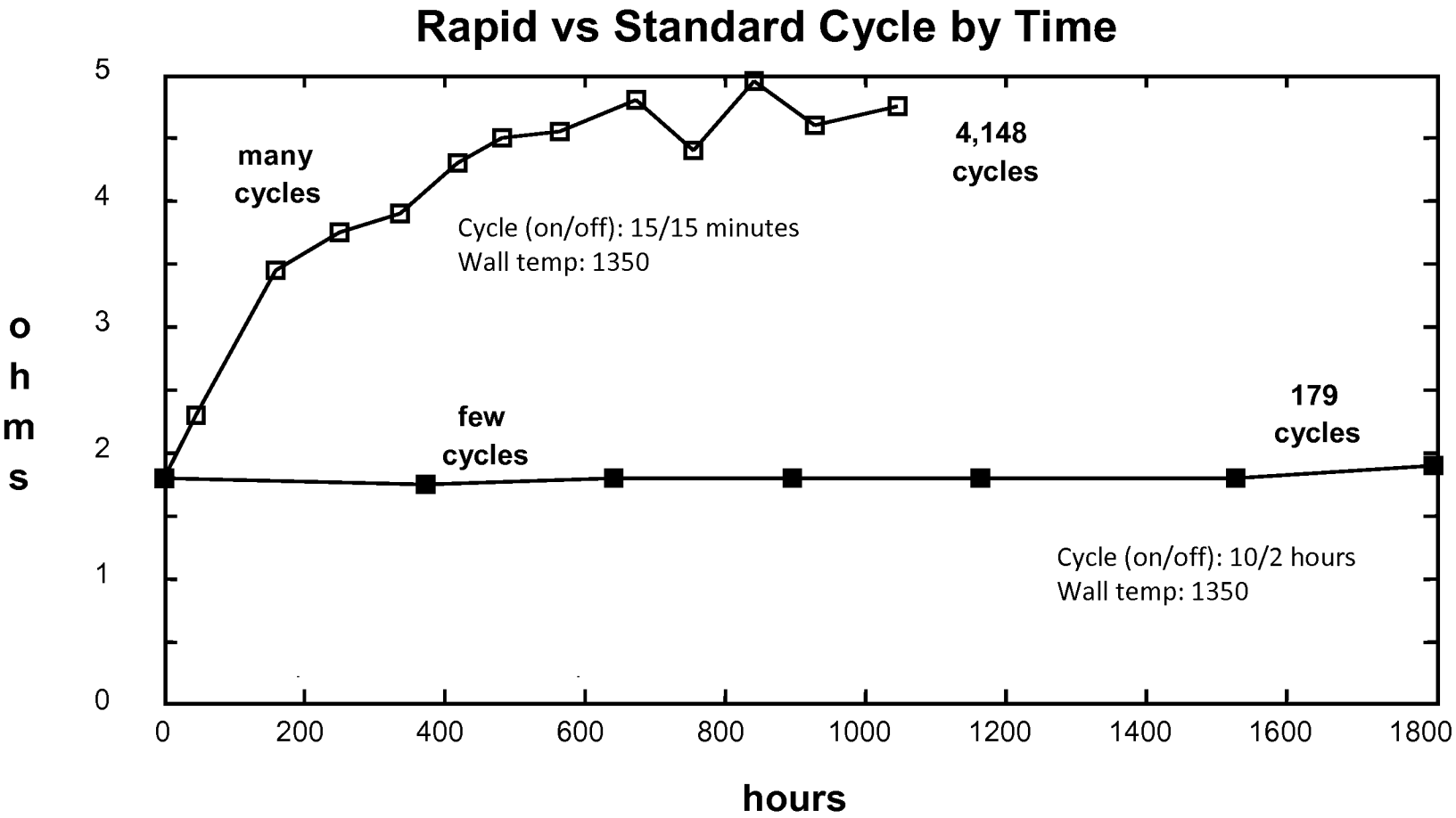
FIG. 6 is a graph illustrating the impact on ignition aid strip resistance for rapid cycling versus standard cycling events over time.

FIG. 6 is a graph illustrating the impact on ignition aid strip resistance for rapid cycling versus standard cycling events over time. In this example case, the ignition aid strips were implemented as follows: 77% tungsten and 23% alumina, 27 μm thick. For lamps running on a standard cycle ("few cycles"), 1,500 hours on and 150 cycles, no measurable effect on ignition aid strip resistance occurs. For rapid cycle lamps ("many cycles") running a cycle comprising 900 hours on with 3,600 cycles, the ignition aid strip resistance has more than doubled. As the lamp ages, the resistance across the ignition aid strip was measured every 100 hours by destroying the outer lamp envelope and measuring the resistance across the ignition aid strip. During the example cycling test, the lamp was turned off and on every thirty minutes (cycle 15/15). As the lamp is turned off and on, the resistance increases, see the upper curve. Compare to the lower curve which has the lamps turn on for 10 hours and off for 2 hours (cycle 10/2). As a result, when the cermet strips face each other, this effect is increased by accelerated aging. The graph illustrates results from a single lamp and the results for a dual arc tube arrangement as variously described herein can be inferred based on the data. Thus by facing the ignition aid strips away from each other, a thermal reduction occurs, extending the life of the lamp.

Numerous variations will be apparent in light of this disclosure. For instance, the example topologies depicted in FIGS. 2 and 4 may be modified to have some combination of lamps with starting aids and some without starting aids. The lamp architecture may also vary from one embodiment to the next, and may include any number of configurations such as alternate framing and stem configurations. As will be further appreciated in light of this disclosure, each of the depicted components can be implemented with conventional or custom technology. Any number of materials and configurations can be used in implementing an embodiment of the present disclosure.

Numerous embodiments and configurations will be apparent in light of this disclosure. For example, one example embodiment provides a lamp. The lamp includes a first non-cycling high pressure arc tube having a first ignition aid, and a second arc tube electrically connected in parallel to the first arc tube. The lamp further includes a lamp envelope enveloping the first and second arc tubes. Each of the first and second arc tubes has an inward facing semicylinder portion and an outward facing semicylinder portion, wherein the inward facing semicylinder portions of the arc tubes face each other and the outward facing semicylinder portions are opposite-facing. In some cases, each of the first and second arc tubes is a non-cycling high pressure sodium arc tube. In one such case, the second arc tube is configured with a second ignition aid. In one such case, each of the first and second ignition aids is configured as an ignition aid strip running lengthwise down the corresponding arc tube. In one such case, each of the first and second ignition aid strips is disposed on the outward facing semicylinder portion of the corresponding arc tube. In another such case, the first and second arc tubes are oriented such that their respective ignition aid strips are effectively 180 degrees+/−90 degrees away from each other. In another such case, each of the first and second ignition aid strips is a cermet strip comprising tungsten. In some cases, the lamp further includes a frame electrically connected to the first and second arc tubes and enveloped by the envelope, a stem electrically connected to the first and second arc tubes and electrically connected to the frame, and a base electrically connected to the stem and operatively connected to the envelope. In some cases, the second arc tube is a low-pressure arc tube.

Another example embodiment of the present invention provides a high pressure discharge lamp. The lamp includes a first non-cycling high pressure sodium arc tube having a first ignition aid strip running lengthwise down the first arc tube, and a second non-cycling high pressure sodium arc tube having a second ignition aid strip running lengthwise down the second arc tube. The lamp further includes a lamp envelope enveloping the first and second arc tubes. Each of the first and second arc tubes has an inward facing semicylinder portion and an outward facing semicylinder portion, wherein the inward facing semicylinder portions of the arc tubes face each other and the outward facing semicylinder portions are opposite-facing. In addition, each of the first and second ignition aid strips is disposed on the outward facing semicylinder portion of the corresponding arc tube. In some embodiments, the first and second arc tubes are oriented such that their respective ignition aid strips are effectively 180 degrees+/−45 degrees away from each other. In some embodiments, the first and second arc tubes are oriented such that their respective ignition aid strips are effectively 180 degrees+/−35 degrees away from each other. In some embodiments, the first and second arc tubes are oriented such that their respective ignition aid strips are effectively 180 degrees+/−25 degrees away from each other. In some embodiments, the first and second arc tubes are oriented such that their respective ignition aid strips are effectively 180 degrees+/−15 degrees away from each other. In some embodiments, the first and second arc tubes are oriented such that their respective ignition aid strips are effectively 180 degrees+/−5 degrees away from each other. In some embodiments, the lamp includes a frame electrically connected to the first and second arc tubes and enveloped by the envelope, a stem electrically connected to the first and second arc tubes and electrically connected to the frame, and a base electrically connected to the stem and operatively connected to the envelope.

Another example embodiment of the present invention provides a lamp assembly method. The method includes providing a first non-cycling high pressure sodium arc tube having a first ignition aid strip running lengthwise down the first arc tube, and providing a second non-cycling high pressure sodium arc tube having a second ignition aid strip running lengthwise down the second arc tube. The method further includes providing a lamp envelope enveloping the first and second arc tubes. In some cases, each of the first and second arc tubes has an inward facing semicylinder portion and an outward facing semicylinder portion, wherein the inward facing semicylinder portions of the arc tubes face each other and the outward facing semicylinder portions are opposite-facing, and the method further includes orienting each of first and second arc tubes so that the first and second ignition aid strips are on the outward facing semicylinder portion of the corresponding arc tube. In some cases, the first and second arc tubes are oriented such that their respective ignition aid strips are effectively 180 degrees+/−90 degrees away from each other. In some cases, the first and second arc tubes are oriented such that their respective ignition aid strips are effectively 180 degrees+/−5 degrees away from each other.

The foregoing descriptions of the embodiments of the invention have been presented for the purposes of illustration and description and are not intended to be drawn to scale. It is not intended to be exhaustive or to limit the invention to the precise form disclosed. Many modifications and variations are possible in light of this disclosure. It is intended that the scope of the invention be limited not by this detailed description, but rather by the claims appended hereto.

What is claimed is:

1. A lamp comprising:

a first non-cycling high pressure arc tube having a first ignition aid;

a second arc tube electrically connected in parallel to the first arc tube; and a lamp envelope enveloping the first and second arc tubes wherein the first arc tube has a first ignition aid running lengthwise down the first arc tube and second arc tube has a second ignition aid running lengthwise down the second arc tube and the first and second arc tubes are oriented such that their respective ignition aid strips are effectively 180 degrees +/−45 degrees away from each other axial about a circumference of the respective tube;

wherein each of the first and second arc tubes has an inward facing semicylinder portion and an outward facing semicylinder portion, wherein the inward facing semicylinder portions of the arc tubes face each other and the outward facing semicylinder portions are opposite-facing.

2. The lamp of claim 1 wherein each of the first and second arc tubes is a non-cycling high pressure sodium arc tube.

3. The lamp of claim 1 wherein each of the first and second ignition aid is disposed on the outward facing semicylinder portion of the corresponding arc tube.

4. The lamp of claim 1 wherein each of the first and second ignition aid strips is a cermet strip comprising tungsten.

5. The lamp of claim 1 further comprising:

a frame electrically connected to the first and second arc tubes and enveloped by the envelope;

a stem electrically connected to the first and second arc tubes and electrically connected to the frame; and a base electrically connected to the stem and operatively connected to the envelope.

6. The lamp of claim 1 wherein the second arc tube is a low-pressure arc tube.

7. A high pressure discharge lamp comprising:

a first non-cycling high pressure sodium arc tube having a first ignition aid strip running lengthwise down the first arc tube;

a second non-cycling high pressure sodium arc tube having a second ignition aid strip running lengthwise down the second arc tube; and a lamp envelope enveloping the first and second arc tubes;

wherein each of the first and second arc tubes has an inward facing semicylinder portion and an outward facing semicylinder portion, wherein the inward facing semicylinder portions of the arc tubes face each other and the outward facing semicylinder portions are opposite-facing; and wherein each of the first and second ignition aid strips is disposed on the outward facing semicylinder portion of the corresponding arc tube and the first and second arc tubes are oriented such that their respective ignition aid strips are effectively 180 degrees +/−45 degrees away from each other.

8. The lamp of claim 7 wherein the first and second arc tubes are oriented such that their respective ignition aid strips are effectively 180 degrees +/−35 degrees away from each other.

9. The lamp of claim 7 wherein the first and second arc tubes are oriented such that their respective ignition aid strips are effectively 180 degrees +/−25 degrees away from each other.

10. The lamp of claim 7 wherein the first and second arc tubes are oriented such that their respective ignition aid strips are effectively 180 degrees +/−15 degrees away from each other.

11. The lamp of claim 7 wherein the first and second arc tubes are oriented such that their respective ignition aid strips are effectively 180 degrees +/−5 degrees away from each other.

12. The lamp of claim 7, further comprising:

a frame electrically connected to the first and second arc tubes and enveloped by the envelope;

a stem electrically connected to the first and second arc tubes and electrically connected to the frame; and a base electrically connected to the stem and operatively connected to the envelope.

13. A lamp assembly method, comprising:

providing a first non-cycling high pressure sodium arc tube having a first ignition aid strip running lengthwise down the first arc tube;

providing a second non-cycling high pressure sodium arc tube having a second ignition aid strip running lengthwise down the second arc tube;

providing a lamp envelope enveloping the first and second arc tubes; and orienting each of first and second arc tubes so that the first and second ignition aid strips are on the outward facing semicylinder portion of the corresponding arc tube and wherein the first and second arc tubes are oriented such that their respective ignition aid strips are effectively 180 degrees degrees away from each other.

14. The method of claim 13 wherein the first and second arc tubes are oriented such that their respective ignition aid strips are effectively 180 degrees +/−45 degrees away from each other.

15. The method of claim 13 wherein the first and second arc tubes are oriented such that their respective ignition aid strips are effectively 180 degrees +/−5 degrees away from each other.

* * * * *